US009675991B2

(12) United States Patent
Vatanen

(10) Patent No.: US 9,675,991 B2
(45) Date of Patent: Jun. 13, 2017

(54) CURTAIN COATING DEVICE

(71) Applicant: Heikki Vatanen, Järvenpää (FI)

(72) Inventor: Heikki Vatanen, Järvenpää (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 246 days.

(21) Appl. No.: 14/729,781

(22) Filed: Jun. 3, 2015

(65) Prior Publication Data

US 2015/0352590 A1 Dec. 10, 2015

(30) Foreign Application Priority Data

Jun. 5, 2014 (EP) ..... 14171250

(51) Int. Cl.

| | |
|---|---|
| ***B05C 11/00*** | (2006.01) |
| ***B05C 5/00*** | (2006.01) |
| ***D21H 23/48*** | (2006.01) |
| *G03C 1/74* | (2006.01) |

(52) U.S. Cl.

CPC ..... *B05C 11/00* (2013.01); *B05C 5/005* (2013.01); *B05C 5/008* (2013.01); *D21H 23/48* (2013.01); *G03C 2001/7433* (2013.01)

(58) Field of Classification Search

None

See application file for complete search history.

(56) References Cited

U.S. PATENT DOCUMENTS 4,479,987 A * 10/1984 Koepke ..... B05C 5/00 118/300
7,160,579 B2 1/2007 Gugler et al.
8,881,674 B2 * 11/2014 Somada ..... G03C 1/74 118/410
2005/0011439 A1 * 1/2005 Gueggi ..... B05C 5/008 118/402
2007/0137563 A1 * 6/2007 Schweizer ..... B05C 5/005 118/411

(Continued)

FOREIGN PATENT DOCUMENTS

| | | | |
|---|---|---|---|
| DE | 102006030183 | A1 | 1/2008 |
| DE | 102009000809 | A1 | 8/2010 |
| EP | 0636423 | A1 | 2/1995 |

(Continued)

OTHER PUBLICATIONS

European Search Report for EP14171250 dated Dec. 1, 2014.

*Primary Examiner* — Charles Capozzi
(74) *Attorney, Agent, or Firm* — Stiennon & Stiennon

(57) ABSTRACT

A curtain coating device for paper and board machines has a nozzle beam (10) with a nozzle lip (12) with an edge strip (11) for feeding the coating color curtain and edge guides (20) located along each edge of the nozzle lips (12) controlling the width of the coating color curtain. The edge guide (20) has upper and lower ends. Flow surfaces (22) extend in a substantially vertical direction parallel and next to each other. The edge guide has a lubrication feed (24), additional lubrication feeds (26) and a suction opening (27). The flow surfaces (22) are inclined toward each other forming a flow guide recess (25) which extends in a vertical direction such that the form of the flow surfaces (22) with the flow guide recess (25) is concave. A protrusion (21) extends within the recess in the direction of the flow guide recess (25).

19 Claims, 3 Drawing Sheets

(56) References Cited

U.S. PATENT DOCUMENTS

| | | | | |
|---|---|---|---|---|
| 2010/0018458 | A1 | 1/2010 | Schweizer et al. | |
| 2011/0059254 | A1* | 3/2011 | Somada ..... | G03C 1/74<br>427/420 |

FOREIGN PATENT DOCUMENTS

| | | | |
|---|---|---|---|
| EP | 1817115 | | 6/2006 |
| EP | 1900441 | A1 | 3/2008 |
| EP | 2292336 | A1 | 3/2011 |
| EP | 2474368 | A1 | 7/2012 |
| FI | 20075893 | A2 | 6/2009 |
| WO | 03049870 | A1 | 6/2003 |
| WO | 2010091986 | A1 | 8/2010 |

* cited by examiner

CURTAIN COATING DEVICE

CROSS REFERENCES TO RELATED APPLICATIONS

This application claims priority on European Application No. EP 14171250, filed Jun. 5, 2014, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a curtain coating device for fiber machines, in particular for paper and board machines. More especially the invention relates to a curtain coating device having a nozzle beam with a nozzle lip with an edge strip for feeding the coating color curtain and edge guides located along each edge of the nozzle lip to control the width of the coating color curtain, wherein each edge guide comprises upper and lower ends, flow surfaces extending in a substantially vertical direction parallel and next to each other, a lubrication feed, additional lubrication feeds and a suction opening.

Coated fiber web grades and coating are becoming more and more popular and thus the coating process and equipment have increasing demands imposed thereon. In coating, especially in pigment coating, the surface of a fiber web is formed with a layer of coating color (coating agent) at a coating station followed by drying. The process of coating can be divided in supplying the coating color onto the web surface, which is called the application of the coating color, as well as in the adjustment of final amount of coating color. One important recently developed coating technique is curtain coating, which is suitable to coat paper and board. By curtain coating good coverage of coating color on the web surface to be coated is achieved.

In curtain coating two main types of curtain coating devices are used, namely slot-fed curtain coating devices and slide-fed curtain coating devices. In the slide fed curtain coating devices, coating color is fed by means of a nozzle assembly onto an inclined plane and the coating color flows down toward an edge of the plane constituting a nozzle lip and the curtain is formed as the coating color falls off the nozzle lip onto the web. In the slot-fed curtain coating devices coating color is pumped through a distribution chamber into a narrow vertical slot and the curtain is formed at its lip and falls onto the web. Coating can be applied in one or more curtain layers.

Typically two different methods are used to control width of the curtain. One is to feed the curtain wider than the width of the fiber web to be coated and then the width is allowed to freely narrow in the cross direction of the web as the curtain falls downwards toward the fiber web. This method is called the out-board method. The other, called the in-board method, is to feed the curtain narrower than the width of the fiber web to be coated, and the width is required to be maintained uniform as the curtain falls downwards toward the fiber web. The curtain is maintained at the required width by means of edge guides which are located along each edge of the feeding slot/the nozzle lip. An edge guide typically comprises a flow surface for guiding the edge of the coating curtain, a lubrication liquid (typically water) supply(s) onto the edge guide, a collecting lip and a suction channel for collecting and removing edge area coating color and lubrication liquid. The present invention relates to in-board curtain coating and to the edge guides used to keep the curtain at a required width.

WO publication 03/049870 discloses an edge guide for a curtain coater which has at least one contact area of its surface directed toward a coating curtain, which contact area has a multiplicity of grooves and ribs extending along the length of the edge guide.

EP patent publication 1817115 discloses an edge guide for a curtain coating device having a guide surface with a guide groove, at least one liquid feed and a quietening section.

EP patent publication 1900441 discloses an edge guide of a curtain coating device, comprising liquid supply means, wherein a member constituting a surface of the edge guide, which faces the coating color layer is a porous material member.

U.S. Pat. No. 7,160,579 discloses an edge guide for a curtain coating device with a groove having incorporated in its surface channels parallel to the direction of the falling curtain and the curtain is stabilized with liquid flow which is supplied to the groove.

One problem in all known edge guides for curtain coating devices is stability of the curtain on the edge guide, especially when the feed amounts of the coating color are low.

Another problem is adhering and drying of the coating color onto the edge guide and especially onto the suction channel of the edge guide, which disturbs the coating process.

Problems at edge areas of the curtain are mainly related to four different factors to which construction of the edge guide effects: first, coating color thickness on the area between the sliding surface of the nozzle beam and the edge strip; second, encounter location of three boundary surfaces where the edge guide is connected to the nozzle beam; third, material, form, and inclination angle of the edge guide and lubrication/moisturizing liquid fed onto the edge guide; and fourth, removal of lubrication/flushing liquid by suction at the lower edge of the edge guide. The present invention relates to the latter three of the above mentioned factors.

In known edge guides for curtain coating devices the encounter location of three boundary surfaces where the edge guide is connected to the nozzle beam is problematic, since this encounter location of three boundary surfaces causes disturbances to the flow of the curtain and differences in surface energy of the surfaces cause problems. The three surfaces include the nozzle beam (the lip of the nozzle), the edge guide and the edge strip.

SUMMARY OF THE INVENTION

An object of the invention is to create a curtain coating device in which the disadvantages of the prior art, especially relating to edge guides, are eliminated or at least minimized.

A further object of the invention is to solve the problems relating to the stability of the curtain on the edge guide.

A further object of the invention is to solve the problem relating to adhering of the drying coating color onto the flow surface and the suction channel of the edge guide.

In order to achieve the above objects and those that will become apparent later, in the curtain coating device according to the invention, flow surfaces are inclined toward each other and form a flow guide recess extending in a vertical direction for curtain edge guidance such that the form of the flow surfaces with the flow guide recess is concave and that in the flow guide recess is located a protrusion extending in the direction of the flow guide recess.

According to the invention the curtain coating device for fiber machines, in particular for paper and board machines, comprises a nozzle beam with a nozzle lip with an edge strip for feeding the coating color curtain and edge guides located along each edge of the nozzle lip to control the width of the coating color curtain, each of which edge guides comprises an upper end, a lower end, flow surfaces extending in a substantially vertical direction parallel and next to each other, a lubrication feed, additional lubrication feeds and a suction opening, which flow surfaces are inclined toward each other and form a flow guide recess extending in the vertical direction for curtain edge guidance such that the form of the flow surfaces with the flow guide recess is concave and that in the flow guide recess is located a protrusion extending in the direction of the flow guide recess.

According to an advantageous feature of the invention, the upper end of the edge guide is at a small distance from the nozzle lip of the nozzle beam. The small distance decreases the number of encounter locations from three boundary surfaces to two. It also helps to make the edge guides to be inclined. If needed, also a width control of the application area on cd-direction is easier to make, such as in the FI patent application 20075893. The upper end of the edge guide can also be touching the nozzle lip.

According to an advantageous feature of the invention, the lubrication liquid feed is located at the boundary of the edge strip and the upper end of the edge guide between the edge strip and the flow surfaces of the edge guide. Some lubrication feeds can be located also on the edge strip area at the nozzle beam.

According to an advantageous feature of the invention, at a distance from the upper end of the edge guide downstream is located at least one additional lubrication feed on one side of the protrusion.

According to an advantageous feature of the invention, at a distance from the upper end of the edge guide downstream are located the additional lubrication feeds on both sides of the protrusion.

According to an advantageous feature of the invention, the upper end of the edge guide is inclinable in respect to the vertical direction by means for adjusting the inclination angle of the edge guide. According to an advantageous feature the inclination angle of the edge guide is adjustable. According to an advantageous feature the inclination angle of the edge guide is adjustable during coating.

According to an advantageous feature the protrusion has an arched form.

According to an advantageous feature the suction opening of the edge guide is located at a lowermost point of the lower part of the edge guide. Some moisturizing feeds can also be located on the suction area to help the suction channel to be kept open.

According to an advantageous feature the edge strip of the nozzle beam is extended over the nozzle lip of the nozzle beam and the edge strip is joined to the edge guide smoothly by a curved form directly or slightly apart.

According to an advantageous feature, as a means for adjusting the inclination angle of the edge guide, there is provided a hinge located at the upper end of the edge guide and the center point of the radius of the curved form in the upper part of the edge guide is substantially on the center line of the hinge. The curved form of the upper part of the edge guide helps to maintain the geometry between the edge guide and edge strip essentially the same when changing the inclination, thus maintaining the flow conditions as required without disturbances.

According to an advantageous feature the edge guide is inclined from the vertical direction about 1° to 3°. Further according to an advantageous feature the edge guide has means for adjusting the inclination angle even during coating.

According to an advantageous feature the suction opening is one suction hole, which has a circular cross section.

According to an advantageous feature the flow surfaces are inclined toward the flow guide recess and the inclination angle of each flow surface is advantageously at least 0.5° and more advantageously 2°-5°.

According to an advantageous aspect of the invention the upper end of the edge guide is at a small distance from the nozzle lip of the nozzle beam. By this the problematic encounter location of three boundary surfaces is removed. According to an advantageous feature the edge strip of the sliding plane on the level of the nozzle beam is extended over the nozzle lip of the nozzle beam, whereby the coating color flows over the edge strip without disturbances. According to an advantageous feature the edge strip is connected to the edge guide smoothly such that to the connecting surface area lubrication liquid is fed from inside the surface. By this a very advantageous construction is achieved as the coating color flow surface continues on a lubricated surface without discontinuity. The lubrication liquid fills any flatness defects on the surface and improves the ratios of surface energy and surface tension between the coating color and its flow surface.

According to an advantageous aspect of the invention the additional lubrication liquid is fed at an advantageous location in respect of the flow of the curtain and thus according to an advantageous feature of the invention additional lubrication liquid is fed at a distance downstream of the curtain on one or on each side of the curtain in a thickness direction of the curtain. During the flow downstream the curtain recovers the required amount of lubrication liquid and the rest of the lubrication liquid keeps the flow surface clean. By this is ensured that an adequate amount of lubrication liquid is fed and thus the lubrication remains good all the way down the edge guide.

According to an advantageous aspect the flow surfaces of the edge guide are inclined toward each other and form the flow guide recess with the protrusion in the center, i.e. where the flow surfaces join in the vertical direction. The flow surfaces are thus inclined toward the protrusion and form the concave recess with the protrusion, which prevents the spreading of the lubrication liquid to surrounding areas. It is know that the curtain seeks support from boundary surfaces, which are close to each other, which might cause the concave surface to be unfavorable but according to an advantageous feature of the invention this is solved by a protrusion located at the bottom of the concave surface, whereby the curtain follows this protrusion.

According to an advantageous aspect of the invention the suction opening for the lubrication liquid removal is located at the curtain edge area at the lowermost part of the edge guide, advantageously at the lowermost point of the edge guide. According to an advantageous feature the suction opening is one suction hole, which has a circular cross section, at the bottom corner of the edge guide. A circular opening is advantageous in respect of cleaning and the location at the bottom corner of the edge guide makes it possible to have the suction opening at the lowest point of the structure. By these the edge guide can be positioned even at contact with the fiber web and at least very near to the fiber web. By the magnitude of the suction necking and separation of the coating color curtain can be controlled. By the circular suction opening is also achieved that the necking of the curtain occurs at the opening and thus the suction opening is maintained clean. The diameter of the circular opening is at least the width of the protrusion, at least 2 mm and advantageously 3-6 mm, to ensure a trouble-free suction without plugging the opening.

In this description and claims by the terms upper, lower, uppermost and lowermost are meant parts in respect of the position of the edge guide in view of the fiber web to be coated such that upper is further from the fiber web and lower is closer in view of the fiber web. The vertical direction is to be considered to be the perpendicular direction in view of the main plane direction of the fiber web.

BRIEF DESCRIPTION OF THE DRAWINGS

In the following the invention will be explained more closely by reference to the accompanying drawings.

DESCRIPTION OF THE PREFERRED EMBODIMENTS

During the course of the following description of FIGS. 1-5C like numbers and signs will be used to identify like elements, parts and part components unless otherwise mentioned. In the figures some references sign have not been repeated for clarity reasons. In the following the examples are described mainly by reference to an edge guide of a curtain coating device of a fiber web in view of simplifying the disclosure but it should be noted that instead of this example any type of an edge guide of a curtain coating device can have similar features and properties in accordance with the invention.

Figure 1:
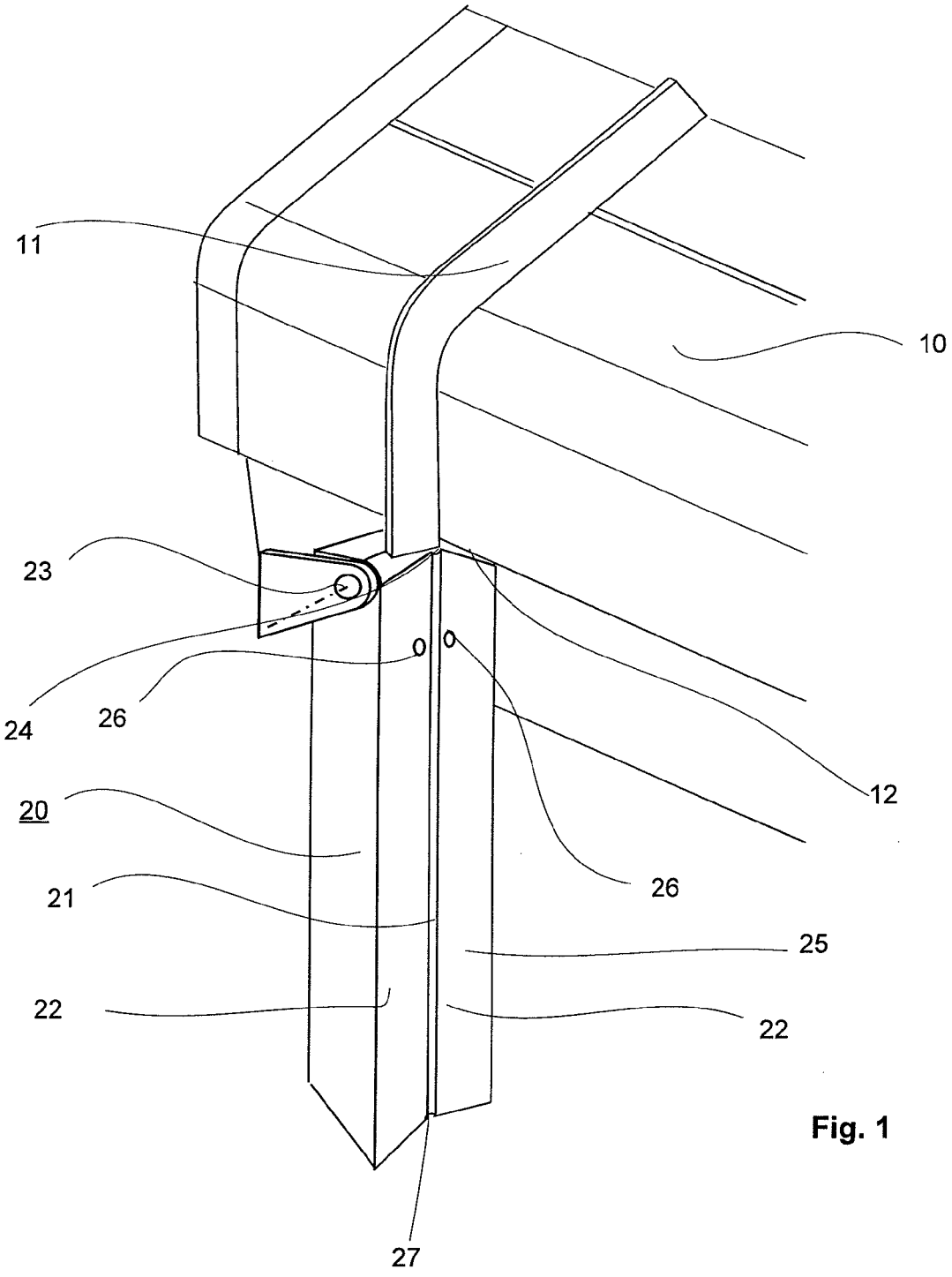
In FIG. 1 is schematically presented one advantageous example of an edge guide of a curtain coating device in accordance with the invention.

In the example of FIG. 1 an edge guide 20 of a curtain coating device is attached to the nozzle beam 10 of the curtain coating device. The coating color curtain is formed by nozzles of the nozzle beam 10 and guided via the nozzle lip 12 toward the fiber web. The width of the coating color curtain is controlled by edge guides 20, of which one is shown in FIG. 1. The edge guide 20 is located below the edge strip 11 of the nozzle beam 10. A second edge guide, not shown, is spaced from the first at the opposite edge of the curtain beneath a second edge strip, not shown. The edge strip 11 guides the curtain to the edge guide 20. The edge guide 20 is connected to the nozzle beam 10 by a hinge 23, by which the inclination of the edge guide 20 in respect of the vertical direction is controllable even during coating. The inclination is advantageously 1-3°. Between the edge strip 11 and the upper end of the edge guide 20 is located a lubrication liquid feed 24, shown in FIG. 2, which feeds lubrication liquid between the edge guide 20 and the edge strip 11. The curtain edge is guided downwards by the flow surfaces 22 of the edge guide 20. As shown in FIG. 1, the flow surfaces 22 form a flow guide recess 25 in the middle and the flow surfaces 22 with the flow guide recess 25 are in concave form. In the flow guide recess 25 is located a protrusion 21 extending in the direction of the flow guide recess 25, which protrusion 21 guides the edge of the coating color curtain in the flow guide recess 25. The protrusion is advantageously shaped so that its form fits inside a half-circle, which has a maximum radius of 7.5 mm. Additional lubrication feeds 26 are located at a distance from the upper end of the edge guide providing lubrication liquid to both sides of the curtain edge in the thickness direction of the curtain. At the lower end of the edge guide in the bottom corner is located a suction opening 27 for removing excess lubrication liquid and for necking the curtain to the fiber web.

Figure 2:
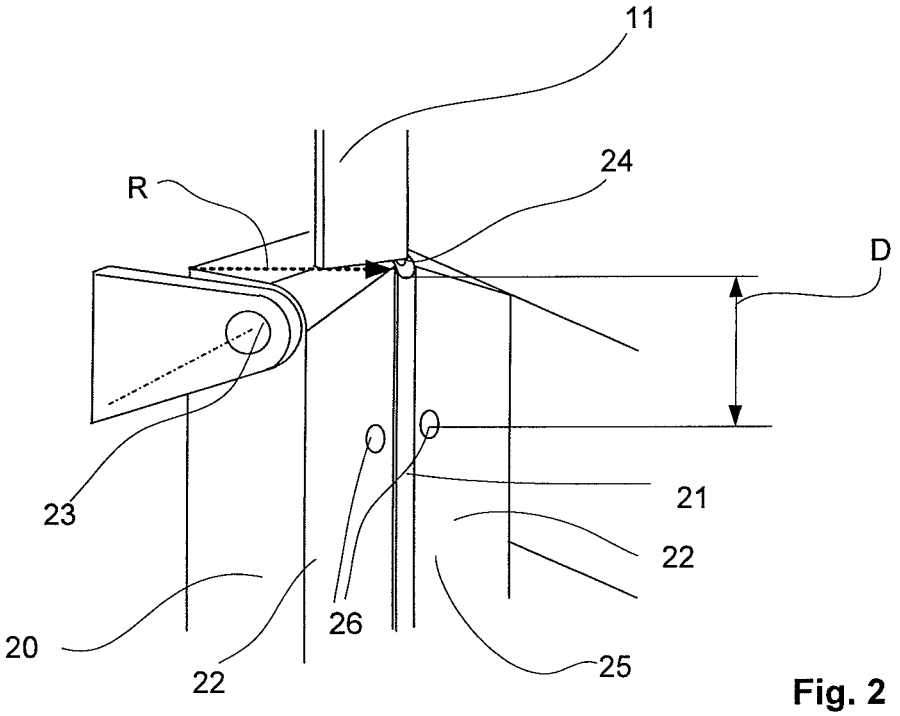
In FIG. 2 is schematically presented the upper part of the edge guide of the example of FIG. 1.

In FIG. 2 is presented the upper part of the edge guide 20 of the example of FIG. 1. As indicated by the arrow R, the uppermost part of the edge guide 20 at the upper end of the edge guide has a curved form with a radius R1 that corresponds to the center line of the hinge 23. The edge strip 11 connects to the upper end of the edge guide 20 smoothly. The lubrication liquid is fed by the lubrication feed 24 from between the edge strip 11 and the upper end of the edge guide 20. The upper end of the edge guide 20 is either touching or located at a small distance, for example 0.5-2 mm, from the edge strip 11. At a distance D, for example 5-50 mm from the upper end of the edge guide 20 the additional lubrication feeds 26 are located.

Figure 3:
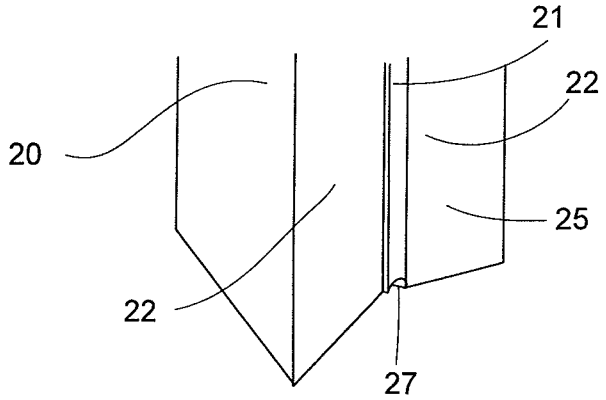
In FIG. 3 is schematically presented the lower part of the edge guide of the example of FIGS. 1 and 2.

In FIG. 3 is presented the lower part of the edge guide 20 of the example of FIGS. 1 and 2. The curtain edge is guided downwards by the flow surfaces 22 of the edge guide 20. The flow surfaces 22 form a flow guide recess 25 in the middle and the flow surfaces 22 with the flow guide recess 25 are in concave form. At the lower end of the edge guide 20 in the bottom corner is located suction opening 27 for removing excess lubrication liquid.

Figure 4:
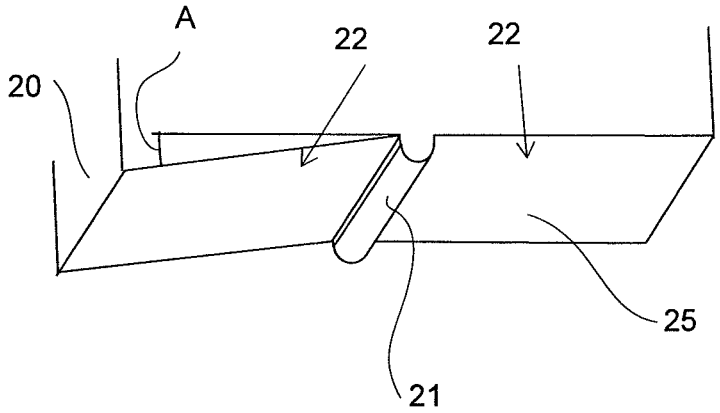
In FIG. 4 is schematically presented the flow surfaces of the edge guide of the example of FIGS. 1-3.

In FIG. 4 is presented the flow surfaces 22 of the edge guide 20 of the example of FIGS. 1-3. The flow surfaces 22 form a flow guide recess 25 in the middle and the flow surfaces 22 with the flow guide recess 25 are in concave form. The flow surfaces 22 are inclined toward the middle and toward the flow guide recess 25 and the inclination angle A is advantageously 2-5°. In the middle of the flow surfaces 22 is formed the flow guide recess 25 with a protrusion 21.

Figure 5A:
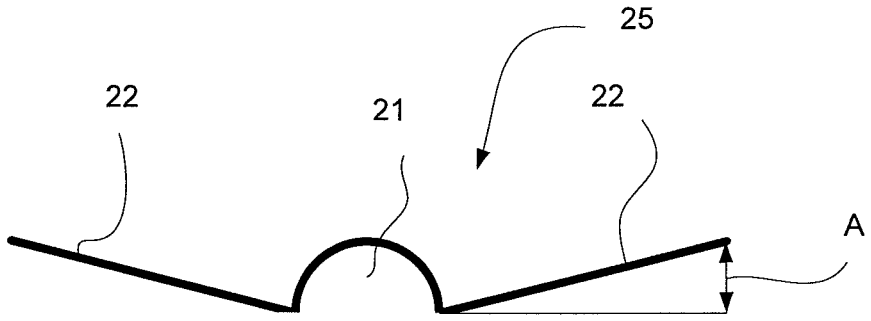
In FIGS. 5A-5C is schematically presented examples of the flow guide recess of the edge guide of a curtain coating device in accordance with the invention.
Figure 5B:
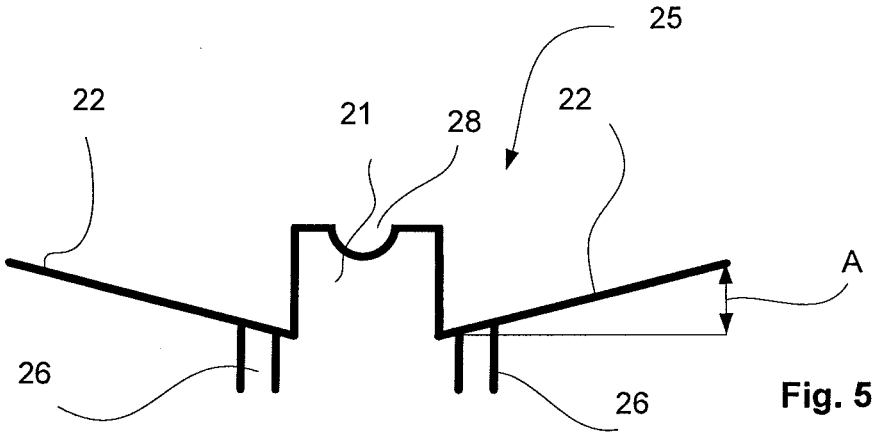
Figure 5C:
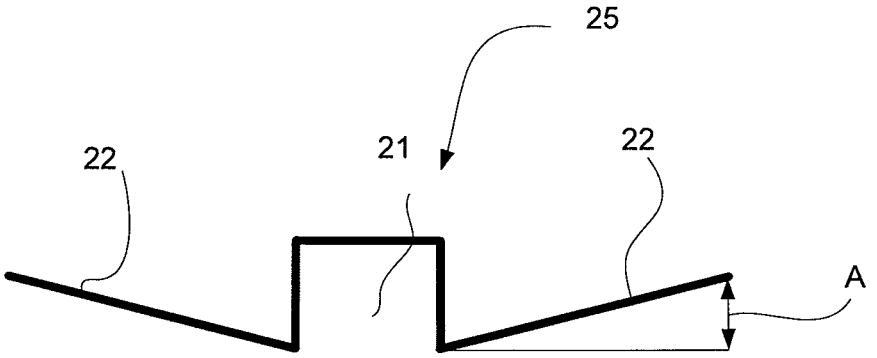

In FIGS. 5A-5C are presented some examples of flow guide recess 25 with the protrusion 21 of the edge guide 20. In FIG. 5A the form of the protrusion 21 is outwards arched and in FIGS. 5B and 5C angular. In the example of FIG. 5B the protrusion 21 has an additional inwards arched groove 28. In FIG. 5B the cross section is shown at the location of the additional lubrication feeds 26, which are located on each side of the protrusion thus lubricating the curtain from each side in thickness direction. The flow surfaces 22 are inclined toward the middle and toward the flow guide recess 25 and the inclination angle A of each flow surface 22 is advantageously 2°-5°. The angle A can be measured with respect to a plane which passes through the two lines where the protrusion 21 intersects the flow surfaces 22. Hence the angle between the two surfaces 22 is advantageously 170°-176°.

In the following some main points of the example of the FIGS. 1-4 are further explained. The curtain coating device comprises a nozzle beam 10 with a nozzle lip 12 with an edge strip 11 for feeding the coating color curtain and edge guides 20, which are located along each edge of the feeding slot/the nozzle lip 12 to control the width of the curtain. The upper end of the edge guide 20 is at a small distance from the nozzle lip 12 of the nozzle beam 10. The edge strip 11 of the nozzle beam 10 is extended over the nozzle lip 12 of the nozzle beam 10, whereby the coating color flows over the edge strip 11 without disturbances. The edge strip 11 is connected to the edge guide 20 smoothly by a curved form. Lubrication liquid is fed to the connecting surface area by lubrication feed 24 from inside onto the surfaces 22. Additional lubrication liquid is fed from additional lubrication feeds 26 at a distance D from the upper end of the edge guide 20 downstream of the curtain on each side of the curtain in the thickness direction of the curtain. The flow surfaces 22 with the flow guide recess 25 of the edge guide 20 are in its form concave toward the curtain. Advantageously the edge guide 20 is inclined from the vertical direction about 1° to 3° and the edge guide 20 has means for adjusting the inclination angle even during coating. The means for adjusting the inclination angle are advantageously the hinge 23 located near the upper end of the edge guide 20 and the center point of the radius R is on the center line of the hinge 23. The suction opening 27 for the lubrication liquid removal is located at the bottom corner of the edge guide at the curtain edge area. Advantageously the suction opening 27 is one suction hole, which has a circular cross section.

In the previous only one advantageous example of the invention is described. Many modifications and alterations are possible in view of the invention.

I claim:

1. A curtain coating device for paper and board machines comprising:

a nozzle beam;

wherein on the nozzle beam are two edge strips which are positioned to contain a coating color curtain as the coating color curtain flows to a nozzle lip of the nozzle beam;

wherein the nozzle lip has first and second edges between which the coating color curtain is contained;

an edge guide located below each of the first and second edges of the nozzle lip so as to control the width of the coating color curtain after the nozzle lip;

wherein each edge guide comprises:

an upper end, and a lower end;

flow surfaces extending downward between the upper end and the lower end in a substantially vertical direction;

wherein the flow surfaces are next to each other and inclined toward each other so as to form a concave surface and to define a concave flow guide recess extending between the flow surfaces, and concave with respect to the coating color curtain, the concave flow guide recess extending in the substantially vertical direction;

a protrusion extending in the substantially vertical direction of the flow guide recess and on the concave surface, wherein the protrusion defines two sides of the concave surface between which is positioned the protrusion;

a lubrication liquid feed and additional lubrication liquid feeds arranged to supply lubrication liquid onto the concave surface; and a suction opening arranged to receive the lubrication liquid supplied by the lubrication liquid feed and the additional lubrication liquid feeds.

2. The curtain coating device of claim 1 wherein the upper end of each edge guides touches the nozzle lip of the nozzle beam.

3. The curtain coating device of claim 1 wherein the upper end of each edge guide is located 0.5-2 mm from the nozzle lip of the nozzle beam.

4. The curtain coating device of claim 1 wherein the lubrication liquid feed is located at a boundary formed by the edge strip and the upper end of each edge guide between the edge strip and the flow surfaces of each edge guide.

5. The curtain coating device of claim 1 wherein at a distance spaced from the upper ends of each edge guide is located at least one of the additional lubrication feeds on at least one of the two sides of the protrusion.

6. The curtain coating device of claim 1 wherein two of the additional lubrication feeds are spaced a distance from the upper end of each edge guide and are located on both of the two sides of the protrusion.

7. The curtain coating device of claim 1 wherein the edge guides are mounted inclinable so as to adjust the substantially vertical direction of the edge guides and so control the width of the coating color curtain after the nozzle lip.

8. The curtain coating device of claim 7 wherein the inclination angle of the edge guide is adjustable during coating.

9. The curtain coating device of claim 8 wherein the protrusion has an arched form.

10. The curtain coating device of claim 1 wherein the suction opening of each of the edge guides is located at a lowermost point of the lower end of each edge guide.

11. The curtain coating device of claim 1 wherein an edge strip of the two edge strips of the nozzle beam extends over the nozzle lip of the nozzle beam and is connected to the edge guides smoothly by a curved form.

12. The curtain coating device of claim 11 wherein each of the edge guides is mounted inclinable by a hinge located on the upper end of the edge guide, the hinge opening about a centerline;

wherein a curved form is defined by a radius and a center point of the radius; and wherein the center point is on the centerline of the hinge.

13. The curtain coating device of claim 10 wherein the suction opening is formed by one suction hole which has a circular cross section.

14. The curtain coating device of claim 1 wherein the angle between the two flow surfaces of an edge guide is 170°-176°.

15. A curtain coating device for paper and board machines comprising:

a nozzle beam having a nozzle lip having first and second edges;

wherein on the nozzle beam are two edge strips positioned to contain a coating color curtain as the coating color curtain flows to the nozzle lip;

an edge guide located below each of the first and second edges of the nozzle lip so as to control the width of the coating color curtain;

wherein each edge guide comprises:

an upper end, and a lower end;

two flow surfaces extending downward between the upper end and the lower end in a substantially vertical direction, wherein the two flow surfaces are inclined toward each other at an angle of from 170°-176° so as to define a concave flow guide recess extending between the two flow surfaces, and being concave with respect to the coating color curtain, the concave flow guide recess extending in the substantially vertical direction;

a protrusion extending in the substantially vertical direction of the flow guide recess and between the two flow surfaces; and a lubrication liquid feed at the upper end of the edge guide and an additional lubrication liquid feed located on each of the two flow surfaces which lubricates the coating color curtain from each side in a thickness direction of the coating color curtain;

a suction opening arranged to receive the lubrication liquid supplied by the lubrication liquid feed and the additional lubrication liquid feeds.

16. The curtain coating device of claim 15 wherein the upper end of each edge guide is located 0-2 mm from the nozzle lip of the nozzle beam.

17. The curtain coating device of claim 15 wherein the lubrication liquid feed is located at a boundary formed by the edge strip and the upper end of each edge guide between the edge strip and the two flow surfaces of each edge guide.

18. The curtain coating device of claim 15 wherein an edge strip of the two edge strips of the nozzle beam extends over the nozzle lip of the nozzle beam and is connected to the edge guides by a smooth curved form, wherein lubrication liquid is fed from inside the smooth curved form.

19. The curtain coating device of claim 15 wherein each of the edge guides is mounted inclinable by a hinge located on the upper end of the edge guide.

* * * * *